US008960338B1

(12) United States Patent
Galloway

(10) Patent No.: US 8,960,338 B1
(45) Date of Patent: Feb. 24, 2015

(54) SUPERABRASIVE COMPACT INCLUDING AT LEAST ONE BRAZE LAYER THEREON

(71) Applicant: US Synthetic Corporation, Orem, UT (US)

(72) Inventor: Robert K. Galloway, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 13/864,971

(22) Filed: Apr. 17, 2013

Related U.S. Application Data

(62) Division of application No. 12/688,175, filed on Jan. 15, 2010, now Pat. No. 8,439,137.

(51) Int. Cl.
*E21B 10/573* (2006.01)
*B21K 5/02* (2006.01)

(52) U.S. Cl.
CPC ..... *E21B 10/573* (2013.01)
USPC ..... 175/432; 175/435; 76/108.2; 76/108.4

(58) Field of Classification Search
USPC ..... 175/426, 432, 435; 76/108.1–108.6
See application file for complete search history.

(56) References Cited

U.S. PATENT DOCUMENTS

| | | | | |
|---|---|---|---|---|
| 2,707,619 | A | | 5/1955 | Andersson |
| 3,459,073 | A | | 8/1969 | Conover |
| 3,693,736 | A | | 9/1972 | Gardner |
| 3,745,623 | A | * | 7/1973 | Wentorf et al. ..... 407/119 |
| 4,156,329 | A | * | 5/1979 | Daniels et al. ..... 51/295 |
| 4,200,159 | A | * | 4/1980 | Peschel et al. ..... 175/428 |
| 4,268,276 | A | | 5/1981 | Bovenkerk |
| 4,350,215 | A | | 9/1982 | Radtke |
| 4,410,054 | A | | 10/1983 | Nagel et al. |
| 4,468,138 | A | | 8/1984 | Nagel |
| 4,560,014 | A | | 12/1985 | Geczy |
| 4,676,124 | A | | 6/1987 | Fischer |
| 4,738,322 | A | | 4/1988 | Hall et al. |
| 4,811,801 | A | | 3/1989 | Salesky et al. |
| 4,913,247 | A | | 4/1990 | Jones |
| 5,012,863 | A | | 5/1991 | Springer |
| 5,016,718 | A | | 5/1991 | Tandberg |
| 5,092,687 | A | | 3/1992 | Hall |
| 5,120,327 | A | | 6/1992 | Dennis |
| 5,135,061 | A | | 8/1992 | Newton, Jr. |
| 5,154,245 | A | | 10/1992 | Waldenstrom et al. |

(Continued)

OTHER PUBLICATIONS

Dictionary definition of "tack welding", accessed Jun. 14, 2013 via thefreedictionary.com.*

(Continued)

*Primary Examiner* — Blake Michener
(74) *Attorney, Agent, or Firm* — Dorsey & Whitney LLP

(57) ABSTRACT

A superabrasive compact (e.g., a polycrystalline diamond compact) including a substrate pre-coated with at least one braze layer and an in-process drill bit assembly including at least one of such superabrasive compacts are disclosed. Pre-coating the substrate with at least one braze layer and dimensioning the pre-coated substrate to fit within the tolerances of a conventionally-sized cutter recess of a drill bit body enables a drill bit manufacture to easily and rapidly braze the disclosed superabrasive compacts into the conventionally-sized cutter recess without substantially decreasing the superabrasive volume of the superabrasive compact.

20 Claims, 8 Drawing Sheets

(56) References Cited

U.S. PATENT DOCUMENTS

| | | | | |
|---|---|---|---|---|
| 5,180,022 | A | 1/1993 | Brady | |
| 5,248,006 | A | 9/1993 | Scott et al. | |
| 5,342,129 | A | 8/1994 | Dennis et al. | |
| 5,348,108 | A | 9/1994 | Scott et al. | |
| 5,355,750 | A | 10/1994 | Scott et al. | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 5,678,645 | A | 10/1997 | Tibbitts et al. | |
| 5,737,980 | A | 4/1998 | Keith et al. | |
| 5,921,333 | A | 7/1999 | Hewitt | |
| 6,098,729 | A | 8/2000 | Matthias | |
| 6,355,356 | B1 * | 3/2002 | Hasz | 428/472 |
| 6,793,681 | B1 | 9/2004 | Pope et al. | |
| 7,267,187 | B2 | 9/2007 | Kembaiyan | |
| 7,389,834 | B1 | 6/2008 | Kembaiyan | |
| 7,814,997 | B2 | 10/2010 | Aliko et al. | |
| 7,909,121 | B2 | 3/2011 | Voronin et al. | |
| 7,997,359 | B2 | 8/2011 | Eason et al. | |
| 2003/0209589 | A1 * | 11/2003 | Hasz et al. | 228/165 |
| 2004/0155096 | A1 | 8/2004 | Zimmerman et al. | |
| 2005/0087371 | A1 | 4/2005 | Kembaiyan | |
| 2005/0089440 | A1 | 4/2005 | Kembaiyan | |
| 2005/0217837 | A1 | 10/2005 | Kudija | |
| 2006/0278441 | A1 * | 12/2006 | Cooley et al. | 175/374 |
| 2007/0056776 | A1 * | 3/2007 | Overstreet | 175/426 |
| 2008/0063889 | A1 | 3/2008 | Duckham et al. | |
| 2008/0073125 | A1 | 3/2008 | Eason et al. | |
| 2008/0085407 | A1 | 4/2008 | Cooley et al. | |
| 2008/0115421 | A1 | 5/2008 | Sani | |
| 2009/0092823 | A1 | 4/2009 | Webb et al. | |
| 2009/0173548 | A1 | 7/2009 | Voronin et al. | |
| 2010/0000798 | A1 | 1/2010 | Patel | |
| 2010/0051352 | A1 | 3/2010 | Prevost | |
| 2010/0187020 | A1 * | 7/2010 | Zhang et al. | 175/428 |
| 2010/0276200 | A1 | 11/2010 | Schwefe et al. | |

OTHER PUBLICATIONS

Dictionary definition of “braze” and “brazing”, accessed Jul. 31, 2014 via thefreedictionary.com.*

U.S. Appl. No. 12/688,175, filed Jan. 15, 2010, Galloway.

U.S. Appl. No. 12/688,175, May 4, 2012, Office Action.

U.S. Appl. No. 12/688,175, Jun. 27, 2012, Office Action.

U.S. Appl. No. 12/688,175, Feb. 5, 2013, Notice of Allowance.

U.S. Appl. No. 12/688,175, Apr. 24, 2013, Issue Notification.

* cited by examiner

SUPERABRASIVE COMPACT INCLUDING AT LEAST ONE BRAZE LAYER THEREON

CROSS-REFERENCE TO RELATED APPLICATIONS

This application is a division of U.S. patent application Ser. No. 12/688,175 filed on 15 Jan. 2010, the disclosure of which is incorporated herein, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer commonly referred to as a diamond table. The diamond table is formed and bonded to a substrate using a high-pressure/high-temperature ("HPHT") process.

A fixed-cutter rotary drill bit typically includes a number of PDC cutting elements affixed to the bit body. PDC cutting elements are typically brazed directly into a preformed recess formed in a bit body of a fixed-cutter rotary drill bit. In some applications, the substrate of the PDC cutting element may be brazed or otherwise joined to an attachment member, such as a cylindrical backing, which may be secured to a bit body by press-fitting or brazing.

SUMMARY

Embodiments of the invention relate to a superabrasive compact (e.g., a PDC) including a substrate pre-coated with at least one braze layer and an in-process drill bit assembly including at least one of such superabrasive compacts. Pre-coating the substrate with at least one braze layer and dimensioning the pre-coated substrate to fit within the tolerances of a conventionally-sized cutter recess of a drill bit body enables a drill bit manufacture to easily and rapidly braze the disclosed superabrasive compacts into the conventionally-sized cutter recess without substantially reducing the superabrasive volume of the superabrasive compact.

In an embodiment, a superabrasive compact includes a superabrasive table including a plurality of bonded superabrasive grains. The superabrasive compact further includes a substrate. The substrate includes an interfacial surface bonded to the superabrasive table, a base surface, and at least one side surface extending between the base surface and the interfacial surface. The superabrasive compact also includes at least one braze layer comprising a base braze portion coating at least a portion of the base surface of the substrate and a side braze portion coating at least a portion of the at least one side surface of the substrate. The side braze portion exhibits a first thickness and the base braze portion exhibits a second thickness that is at least about 10 times the first thickness.

In an embodiment, a superabrasive compact includes a superabrasive table including a plurality of bonded superabrasive grains. The superabrasive compact further includes a substrate. The substrate includes an interfacial surface bonded to the superabrasive table, a base surface, and at least one side surface extending between the base surface and the interfacial surface. The at least one side surface of the substrate is substantially free of braze material thereon. The superabrasive compact also includes at least one braze layer bonded to at least a portion of the base surface.

In an embodiment, an in-process rotary drill bit assembly includes a bit body configured to engage a subterranean formation. The bit body includes a plurality of recesses formed therein. A plurality of superabrasive cutting elements are provided, with each superabrasive element positioned in a corresponding one of the plurality of recesses. One or more of the superabrasive cutting elements include a superabrasive table including a plurality of bonded superabrasive grains and a substrate. The substrate includes an interfacial surface bonded to the superabrasive table, a base surface, and at least one side surface extending between the base surface and the interfacial surface. The at least one side surface and the corresponding one of the plurality of recesses define a braze offset therebetween. At least one braze layer is provided that includes a base braze portion coating at least a portion of the base surface of the substrate and a side braze portion coating at least a portion of the at least one side surface of the substrate. The side braze portion exhibits a thickness that is less than the braze offset. The at least one braze layer is not brazed to the bit body.

In an embodiment, an in-process rotary drill bit assembly includes a bit body configured to engage a subterranean formation. The bit body includes a plurality of recesses formed therein. A plurality of superabrasive cutting elements are provided, with each superabrasive element positioned in a corresponding one of the plurality of recesses. One or more of the superabrasive cutting elements include a superabrasive table including a plurality of bonded superabrasive grains and a substrate. The substrate includes an interfacial surface bonded to the superabrasive table, a base surface, and at least one side surface extending between the base surface and the interfacial surface. The at least one side surface of the substrate is substantially free of braze material thereon. At least one braze layer is provided that is bonded to at least a portion the base surface and not brazed to the bit body.

Other embodiments relate to applications utilizing the disclosed superabrasive compacts in various articles and apparatuses, such as bearing apparatuses, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to a superabrasive compact (e.g., a PDC) including a substrate pre-coated with at least one braze layer and an in-process drill bit assembly including at least one of such superabrasive compacts. Pre-coating the substrate with at least one braze layer and dimensioning the pre-coated substrate to fit within the a conventionally-sized cutter recess of a drill bit body enables a drill bit manufacture to easily and rapidly braze the disclosed superabrasive compacts into the conventionally-sized cutter recess without substantially reducing the superabrasive volume of the superabrasive compact. The superabrasive compact embodiments disclosed herein may be used in a variety of applications, such as rotary drill bits, bearing apparatuses, machining equipment, and other articles and apparatuses.

Figure 1A:
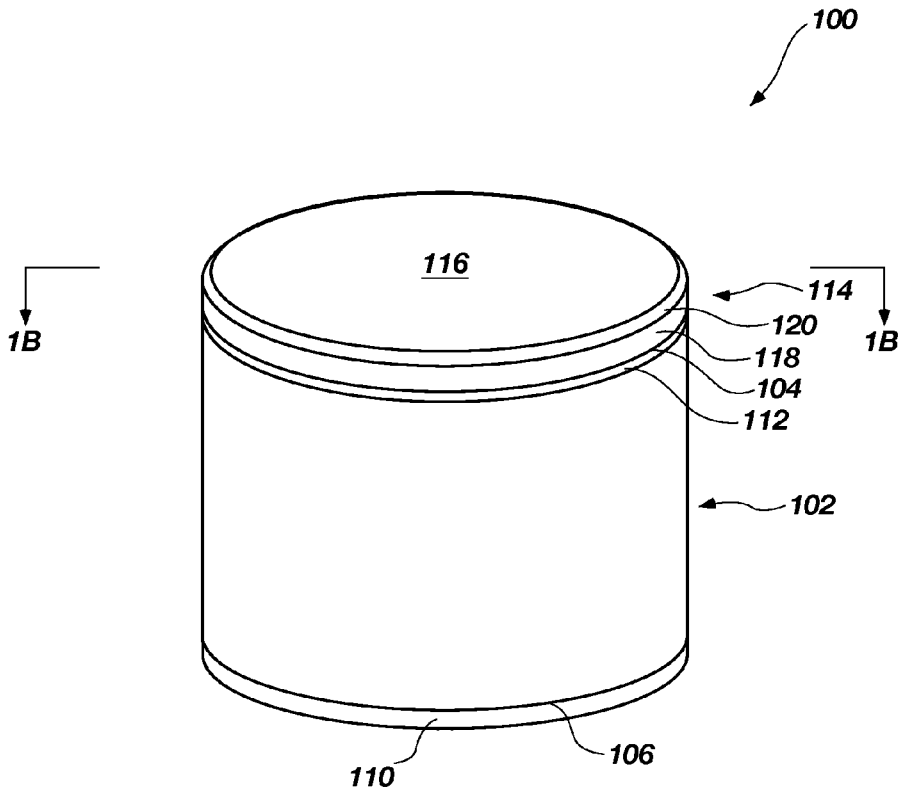
FIG. 1A is an isometric view of an embodiment of a superabrasive compact including a substrate having a braze layer coating a side surface and a base surface thereof.
Figure 1B:
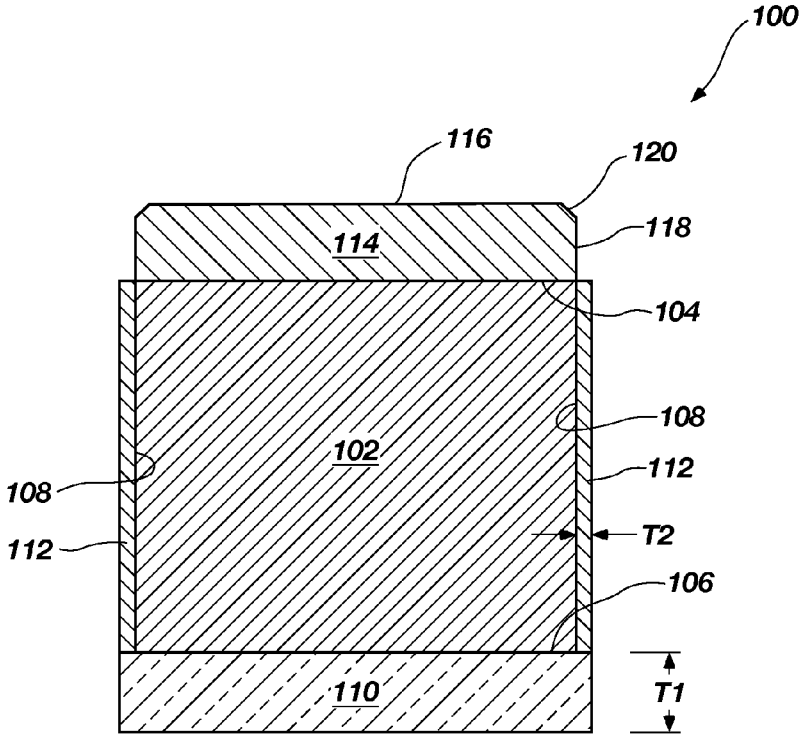
FIG. 1B is a cross-sectional view of the superabrasive compact shown in FIG. 1A taken along line 1B-1B.

FIGS. 1A and 1B are isometric and cross-sectional views, respectively, of a superabrasive compact 100 according to an embodiment. The superabrasive compact 100 includes a substrate 102 having an interfacial surface 104, a base surface 106 spaced from the interfacial surface 104, and a side surface 108 (FIG. 1B) extending between the interfacial surface 104 and the base surface 106. In the illustrated embodiment, the superabrasive compact 100 is cylindrical. However, in other embodiments, the superabrasive compact 100 may be non-cylindrical, such as elliptical, rectangular, triangular, or other suitable configuration. Additionally, although the interfacial surface 104 is illustrated as being substantially planar, in other embodiments, the interfacial surface 104 may exhibit a selected nonplanar topography.

The substrate 102 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the substrate 102 comprises cobalt-cemented tungsten carbide.

Figure 1C:
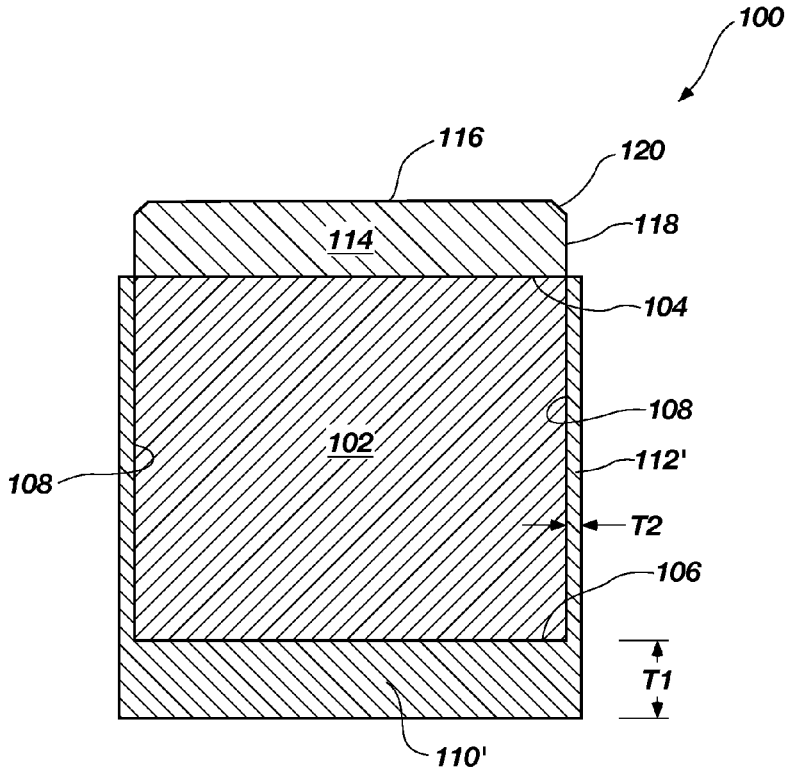
FIG. 1C is a cross-sectional view of the superabrasive compact shown in FIG. 1A taken along line 1B-1B, with the base and side braze portions forming a single, continuous, integral braze layer according to another embodiment.

At least one braze layer is disposed on the substrate 100. In the illustrated embodiment, the at least one braze layer includes a base braze portion 110 coating over and bonded to at least a portion of the base surface 106 and a side braze portion 112 coating over and bonded to at least a portion of the side surface 108. For example, the side braze portion 112 may extend from the base surface 106 to no further than the interfacial surface 104 of the substrate 102. Referring to FIG. 1C, in some embodiments, the base braze portion 110 and the side braze portion 112 may form a single, continuous, integral braze layer having a base braze portion 110' and a side braze portion 112'.

Referring again to FIG. 1B, a thickness T1 of the base braze portion 110 may be at least about 10 times a thickness T2 of the side braze portion 112 so that the pre-coated substrate 100 may fit in a conventionally-sized cutter recess of a drill bit body. For example, the thickness T1 may be as about 10 to about 100 times the thickness T2, about 100 to about 500 times the thickness T2, or about 500 to about 1000 times the thickness T2. As another example, the thickness T1 may be about 0.100 inch to about 0.500 inch, about 0.100 inch to about 0.250 inch, about 0.250 inch to about 0.350 inch while the thickness T2 may be about less than 0.0010 inch, about 0.00025 inch to about 0.00090 inch, about 0.00025 inch to about 0.00050 inch, or about 0.00030 to about 0.00050 inch. By maintaining the thickness T2 sufficiently less than the thickness T1, the superabrasive compact 100 may fit within the tolerances of a conventionally-sized cutter recess of a drill bit body without substantially reducing the volume of a superabrasive table 114 of the superabrasive compact 100 and a lateral dimension (e.g., a diameter) of the substrate 102.

In an embodiment, the base braze portion 110 and/or the side braze portion 112 may be made from a foil having a selected braze alloy composition and thickness. The respective foils may be bonded to the substrate 102 via an adhesive, tack welding (e.g., laser tack welding), or another suitable bonding process. In another embodiment, the base braze portion 110 and/or the side braze portion 112 may be deposited onto the substrate 102 with a selected thickness via a physical deposition process, such as chemical vapor deposition, sputtering, electron-beam physical vapor deposition, or another suitable deposition technique. In a further embodiment, the base braze portion 110 and/or the side braze portion 112 may be formed by casting braze alloy about the substrate 102. In yet another embodiment, the side braze portion 112 may be deposited by dipping the substrate 102 and/or the superabrasive table 114 bonded thereto into a molten bath of the braze alloy. In some embodiments, a disk may be adhered to the base surface 106 or a pre-existing base braze layer by an adhesive, tack welding (e.g., laser tack welding), or another suitable bonding process to increase the thickness of the base braze portion 110.

Suitable braze alloys for the base braze portion 110 and side braze portion 112 may be selected from gold alloys, silver alloys, iron-nickel alloys, and other suitable braze alloys. In an embodiment, the braze alloy may include about 4.5 weight % ("wt %") titanium, about 26.7 wt % copper, and about 68.8 wt % silver, otherwise known as Ticusil®, which is currently commercially available from Wesgo Metals of Hayward, Calif. In another embodiment, the braze alloy may include about 25 wt % silver, about 37 wt % copper, about 10 wt % nickel, about 15 wt % palladium, and about 13 wt % manganese, otherwise known as Palnicrurom® 10, which is also currently commercially available from Wesgo Metals of Hayward, Calif. In a further embodiment, the braze alloy may include about 64 wt % iron and about 36 wt % nickel, which is often referred to as Invar. Other suitable braze alloys include AWS BAg-1 (44-46 wt % Ag, 14-16 wt % Cu, 14-18 wt % Zn, and 23-25 wt % Cd), AWS BAg-7 (55-57 wt % Ag, 21-23 wt % Cu, 15-19 wt % Zn, and 4.5-5.5 wt % Sn), and AWS BAg-24 (59-51 wt % Ag, 19-21 wt % Cu, 26-30 wt % Zn, and 1.5-2.5 wt % Ni).

The superabrasive table 114 of the superabrasive compact 100 is bonded to the interfacial surface 104 of the substrate 102. The superabrasive table 114 includes an upper surface 116, at least one side surface 118, and an optional chamfer 120 extending therebetween. The superabrasive table 114 may be made from a number of different superabrasive materials, such as PCD, polycrystalline cubic boron nitride, diamond grains bonded together with silicon carbide, or combinations of the foregoing. In an embodiment, the superabrasive table 114 is a PCD table that includes a plurality of directly bonded-together diamond grains exhibiting diamond-to-diamond bonding therebetween (e.g., $sp^3$ bonding), which define a plurality of interstitial regions. A portion of or substantially all of the interstitial regions of the superabrasive table 114 may include a metal-solvent catalyst disposed therein that is infiltrated from the substrate 102 or from another source. For example, the metal-solvent catalyst may be selected from iron, nickel, cobalt, and alloys of the foregoing metals.

In an embodiment, the superabrasive table 114 may be integrally formed with the substrate 102. For example, the superabrasive table 114 may be a PCD table that is integrally formed with the substrate 102. In such an embodiment, the infiltrated metal-solvent catalyst is used to catalyze formation of the superabrasive table 114 from diamond powder during HPHT processing. In another embodiment, the superabrasive table 114 may be a pre-sintered superabrasive table that has been HPHT bonded to the substrate 102 in a second HPHT process after being initially formed in a first HPHT process. For example, the superabrasive table 114 may be a pre-sintered PCD table that has been HPHT bonded to the substrate 102.

Figure 1D:
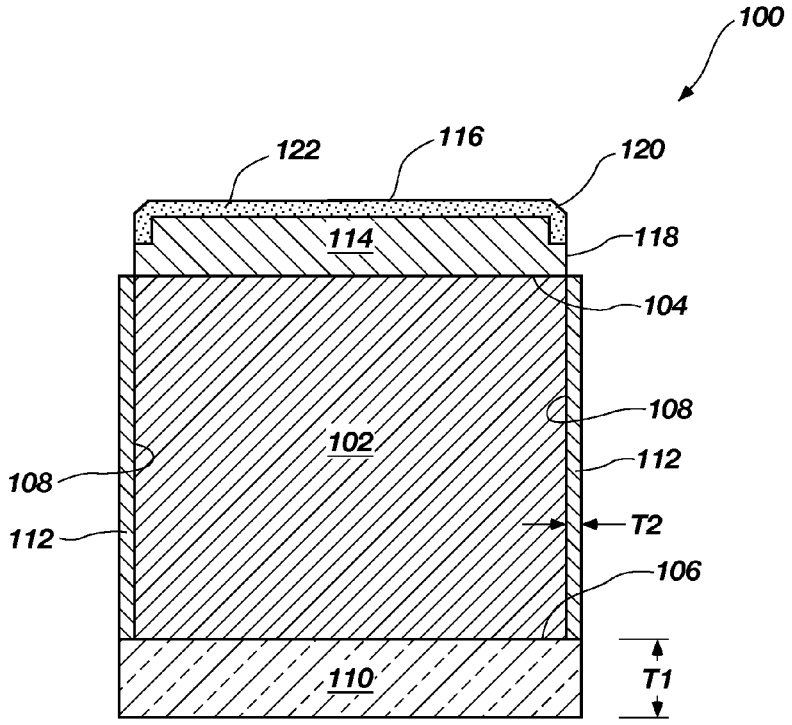
FIG. 1D is a cross-sectional view of the superabrasive compact shown in FIG. 1A taken along line 1B-1B, with the superabrasive table being leached to improve the thermal stability thereof according to an embodiment.

Referring to the cross-sectional view in FIG. 1D, in some embodiments, the superabrasive 114 may be leached to deplete a metallic infiltrant therefrom in order to enhance the thermal stability of the superabrasive table 114. For example, when the superabrasive table 114 is a PCD table, the superabrasive table 114 may be leached to remove at least a portion of the metal-solvent catalyst from a region (e.g., a working region) thereof that was used to initially sinter the diamond grains to form a leached thermally-stable region 122. The leached thermally-stable region 122 extends inwardly from the upper surface 116, the side surface 118, and the chamfer 120 to any selected depth while the underlying superabrasive table 114 is relatively unaffected. For example, the selected depth may be about 10 μm to about 500 μm, such as about 50 μm to about 100 μm or about 200 μm to about 350 μm. For example, the leaching may be performed in a suitable acid, such as aqua regia, nitric acid, hydrofluoric acid, or mixtures of the foregoing prior to or after the base braze portion 110 and the side braze portion 112 is applied to the substrate 102.

Figure 2:
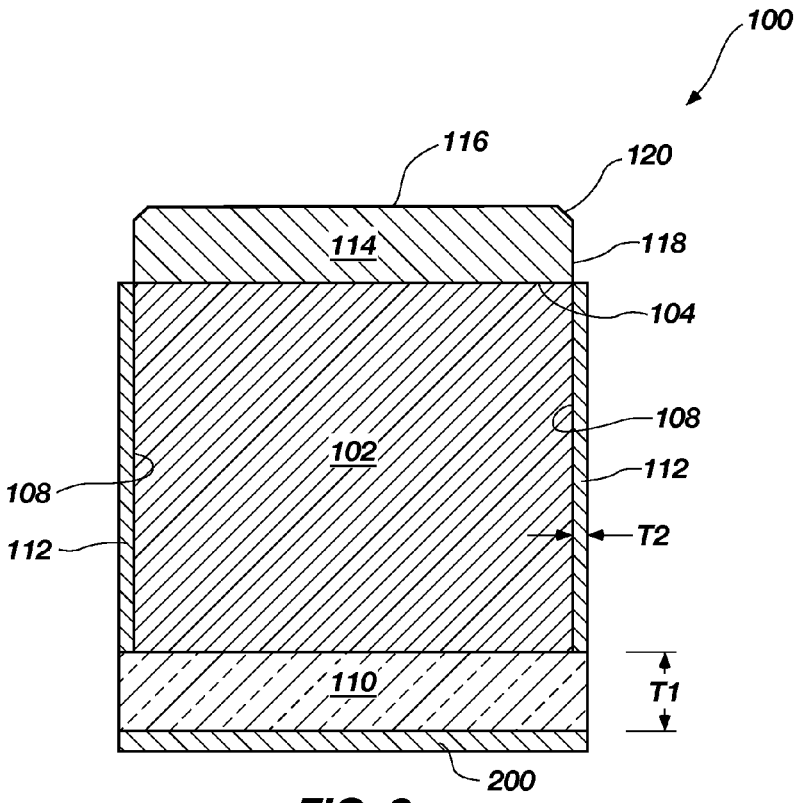
FIG. 2 is a cross-sectional view of the superabrasive compact shown in FIG. 1B including at least one wetting agent layer coating the base portion of the braze layer according to an embodiment.

FIG. 2 is a cross-sectional view of the superabrasive compact 100 shown in FIG. 1B including at least one wetting agent layer 200 coating some or all of the base braze portion 110 according to an embodiment. The wetting agent layer 200 may include one or more wetting agents. For example, suitable wetting agents include, but are not limited to, fluoride-based fluxes, borate-based fluxes, and fluoride-borate-based fluxes. For example, one suitable flux is Handy Flux® B-1, which is commercially available from Lucas-Milhaupt, Inc of Cudahy, Wis. The wetting agent may be in form of a paste or a powder in which flux particles are held together with a suitable organic binder. The wetting agent layer 200 may be applied to the base braze portion 110 as a liquid or slurry that is subsequently allowed to dry.

Figure 3:
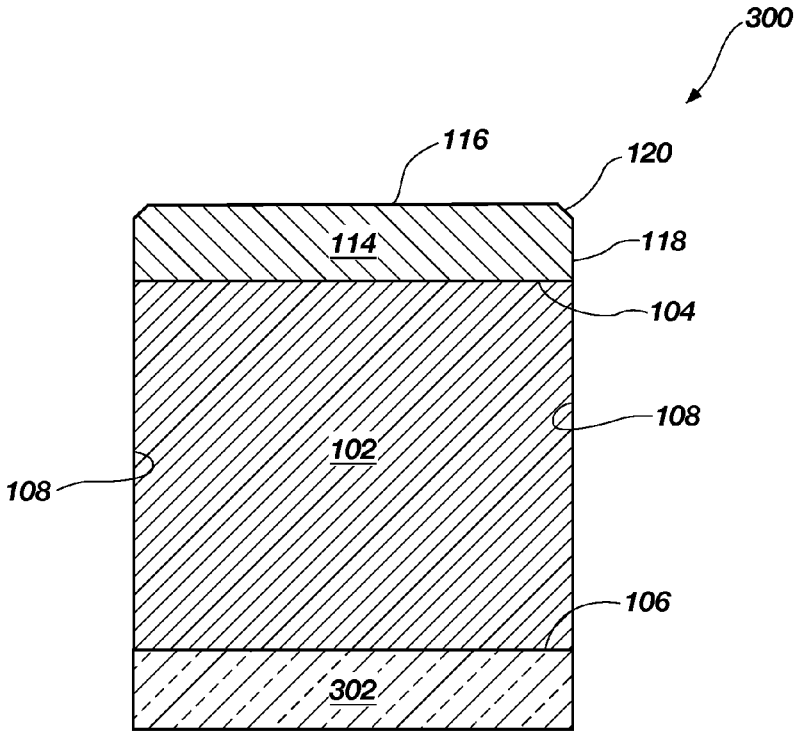
FIG. 3 is a cross-sectional view of an embodiment of a superabrasive compact including a substrate having a braze layer coating only a base surface thereof

FIG. 3 is a cross-sectional view of an embodiment of a superabrasive compact 300. The superabrasive compact 300 has many of the same components and features that are included in the superabrasive compact 100 of FIGS. 1A-1D. Therefore, in the interest of brevity, the components and features of the superabrasive compacts 100 and 300 that correspond to each other have been provided with the same or similar reference numerals, and an explanation thereof will not be repeated.

Figure 4:
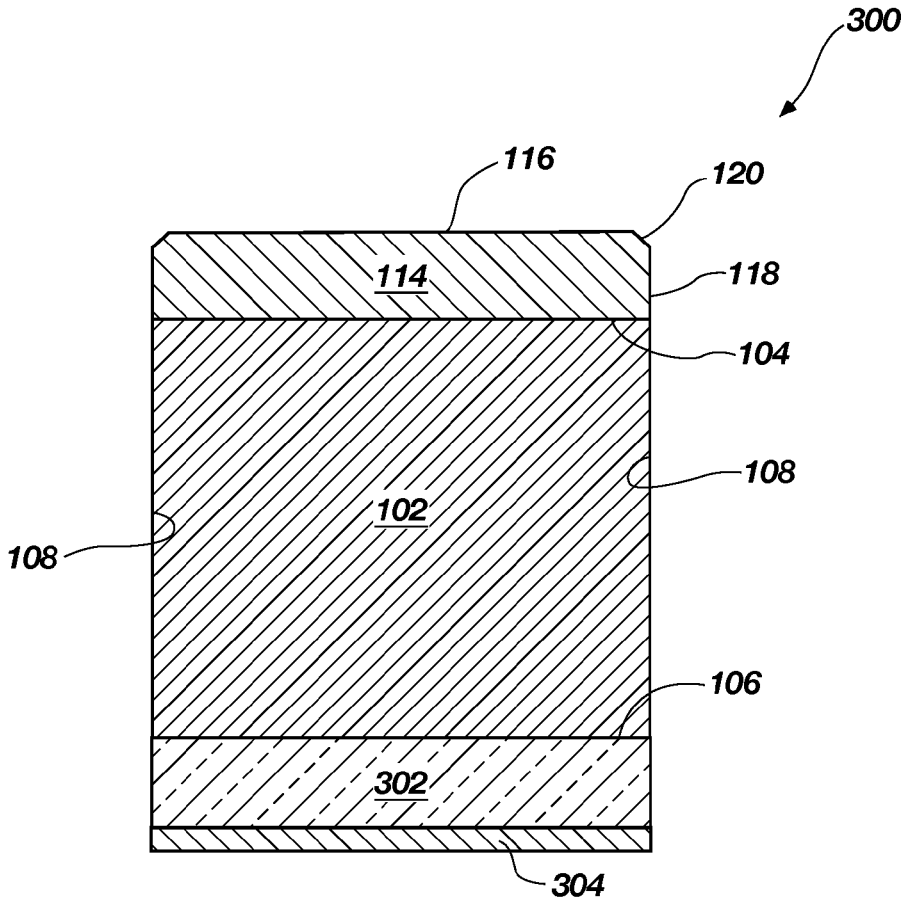
FIG. 4 is a cross-sectional view of the superabrasive compact shown in FIG. 3 including a wetting agent coating the braze layer in accordance with an embodiment.

In the superabrasive compact 300, the base surface 106 of the substrate 102 is the only portion of the substrate 102 that is coated with a braze layer 302 comprising a braze alloy. The braze alloy may be formed from any of the braze alloys disclosed herein, exhibit any of the thicknesses described above for the base braze portion 110, and may be applied to the base surface 106 using any of the application techniques disclosed herein. By only coating the base surface 106 of the substrate 102 and not the side surface 104, the superabrasive compact 300 may be used in a conventionally-sized cutter recess of a drill bit body and exhibit the size of a conventionally-sized superabrasive compact. Referring to FIG. 4, in some embodiments, a wetting agent layer 304 made from the same materials as the wetting agent layer 200 may be applied to the braze layer 302.

The superabrasive compacts disclosed herein may be fabricated in accordance with a number of different embodiments. For example, the superabrasive compact 100 may be fabricated by placing a plurality of superabrasive particles (e.g., a plurality of diamond particles and/or cubic boron nitride particles) adjacent to the interfacial surface 104 of the substrate 102.

The plurality of superabrasive particles may exhibit one or more selected sizes. The one or more selected sizes may be determined, for example, by passing the superabrasive particles through one or more sizing sieves or by any other method. In an embodiment, the plurality of superabrasive particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of superabrasive particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of superabrasive particles may include a portion exhibiting a relatively larger size between about 40 μm and about 15 μm and another portion exhibiting a relatively smaller size between about 12 μm and 2 μm. Of course, the plurality of superabrasive particles may also include three or more different sizes (e.g., one relatively larger size and two or more relatively smaller sizes) without limitation.

The assembly of the substrate 102 and superabrasive particles may be placed in a pressure transmitting medium, such as a refractory metal can embedded in pyrophyllite or other pressure transmitting medium. The pressure transmitting medium, including the substrate 102 and the superabrasive particles therein, may be subjected to an HPHT process using an ultra-high pressure press to create temperature and pressure conditions at which, for example, diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 8.0 GPa) for a time sufficient to, for example, sinter the superabrasive particles to form the superabrasive table 114 (FIGS. 1A-1D) therefrom. For example, the pressure of the HPHT process may be about 5 GPa to about 7 GPa and the temperature of the HPHT process may be about 1150° C. to about 1450° C. (e.g., about 1200° C. to about 1400° C.). Upon cooling from the HPHT process, the superabrasive table 114 may become metallurgically bonded to the substrate 102.

During the HPHT process, a metal-solvent catalyst from the substrate 102 or another source may liquefy and infiltrate into the superabrasive particles. When the superabrasive particles are diamond particles, the infiltrated metal-solvent catalyst may function as a catalyst that catalyzes formation of directly bonded-together diamond grains from the diamond particles to form the superabrasive table 114 (FIGS. 1A-1D). For example, cobalt from a cobalt-cemented tungsten carbide substrate may infiltrate into the diamond particles to catalyze formation of PCD therefrom.

In another embodiment, an at least partially leached PCD table may be disposed on the substrate 102 to form an assembly instead of superabrasive particles to be sintered. The at least partially leached PCD table is porous so that fluid can infiltrate through it. The at least partially leached PCD table may be fabricated by subjecting a plurality of diamond particles to an HPHT sintering process in the presence of a metal-solvent catalyst (e.g., cobalt, nickel, iron, or alloys thereof) to facilitate intergrowth between the diamond particles and form a PCD body comprised of bonded diamond grains that exhibit diamond-to-diamond bonding therebetween. For example, the metal-solvent catalyst may be mixed with the diamond particles having any of the diamond particle sizes or distributions disclosed herein, infiltrated from a metal-solvent catalyst foil or powder adjacent to the diamond particles, infiltrated from a metal-solvent catalyst present in a cemented carbide substrate, or combinations of the foregoing. The bonded diamond grains, so formed by HPHT sintering the diamond particles, define interstitial regions with the metal-solvent catalyst disposed within the interstitial regions.

The as-sintered PCD body may be leached by immersion in an acid, such as aqua regia, nitric acid, hydrofluoric acid, or subjected to another suitable process to remove at least a portion of the metal-solvent catalyst from the interstitial regions of the PCD body and form the at least partially leached PCD table. For example, the as-sintered PCD body may be immersed in the acid for about 2 to about 7 days (e.g., about 3, 5, or 7 days) or for a few weeks (e.g., about 4 weeks) depending on the process employed. It is noted that when the metal-solvent catalyst is infiltrated into the diamond particles from a cemented tungsten carbide substrate including tungsten carbide particles cemented with a metal-solvent catalyst (e.g., cobalt, nickel, iron, or alloys thereof), the infiltrated metal-solvent catalyst may carry tungsten and/or tungsten carbide therewith and the as-sintered PCD body may include such tungsten and/or tungsten carbide therein disposed interstitially between the bonded diamond grains. The tungsten and/or tungsten carbide may not be substantially removed by the leaching process and may enhance the wear resistance of the at least partially leached PCD table so-formed.

The assembly may be placed in a pressure transmitting medium, such as a refractory metal can embedded in pyrophyllite or other pressure transmitting medium. The pressure transmitting medium, including the assembly, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 8.0 GPa) so that the metal-solvent catalyst in the substrate 102 may be liquefied and infiltrate into the at least partially leached PCD table. For example, the pressure of the HPHT process may be about 5 GPa to about 7 GPa and the temperature of the HPHT process may be about 1150° C. to about 1450° C. (e.g., about 1200° C. to about 1400° C.). Upon cooling from the HPHT process, in an embodiment, the infiltrated PCD table becomes bonded to the substrate 102.

Regardless of whether the superabrasive table 114 is integrally formed with the substrate 102 or an at least partially leached PCD table that is infiltrated, the base surface 106 and, when desired, the side surface 108 of the substrate 102 may be at least partially coated with a braze alloy as described above. The braze alloy may be coated onto the substrate 102 after HPHT processing.

Figure 5A:
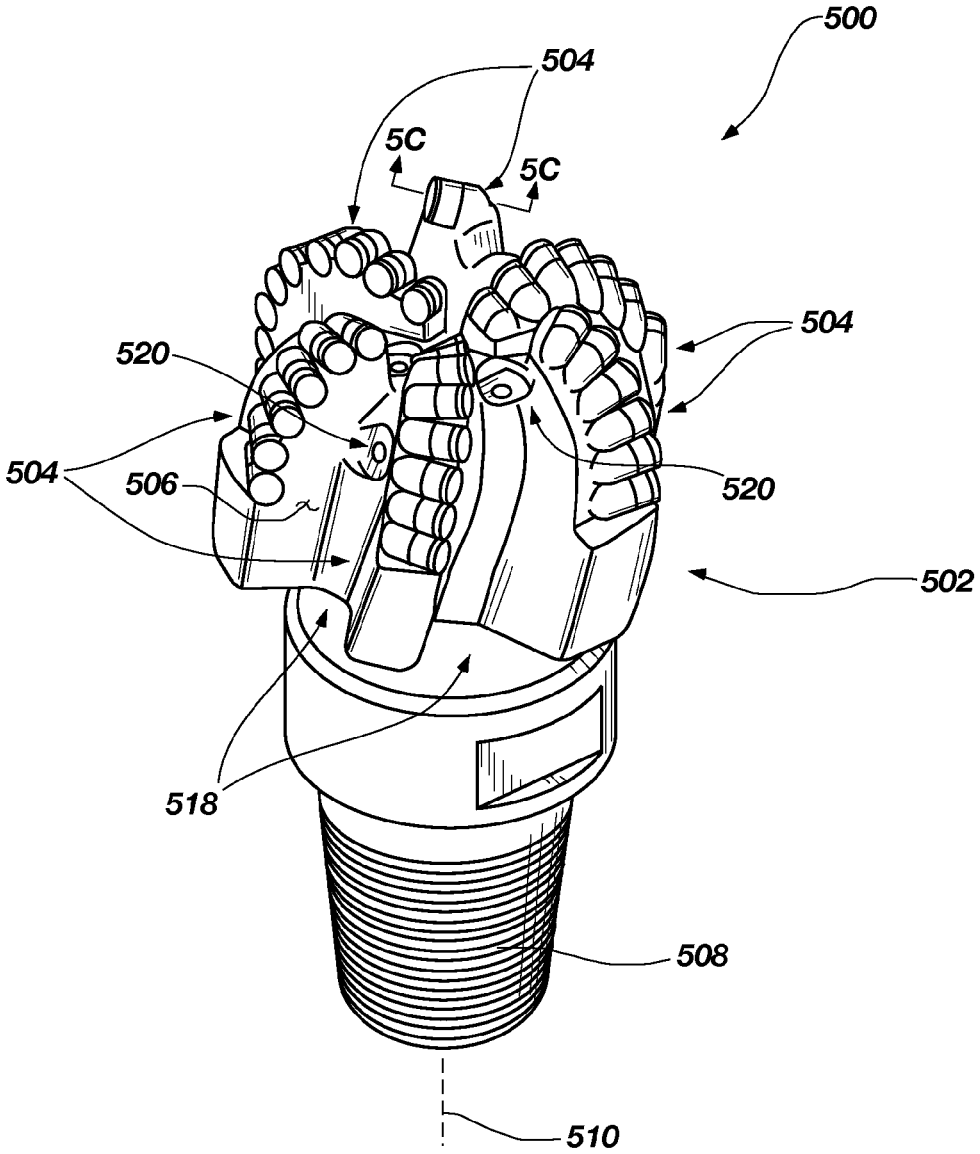
FIG. 5A is an isometric view of an embodiment of an in-process rotary drill bit assembly that may employ one or more of the disclosed superabrasive compact embodiments.
Figure 5B:
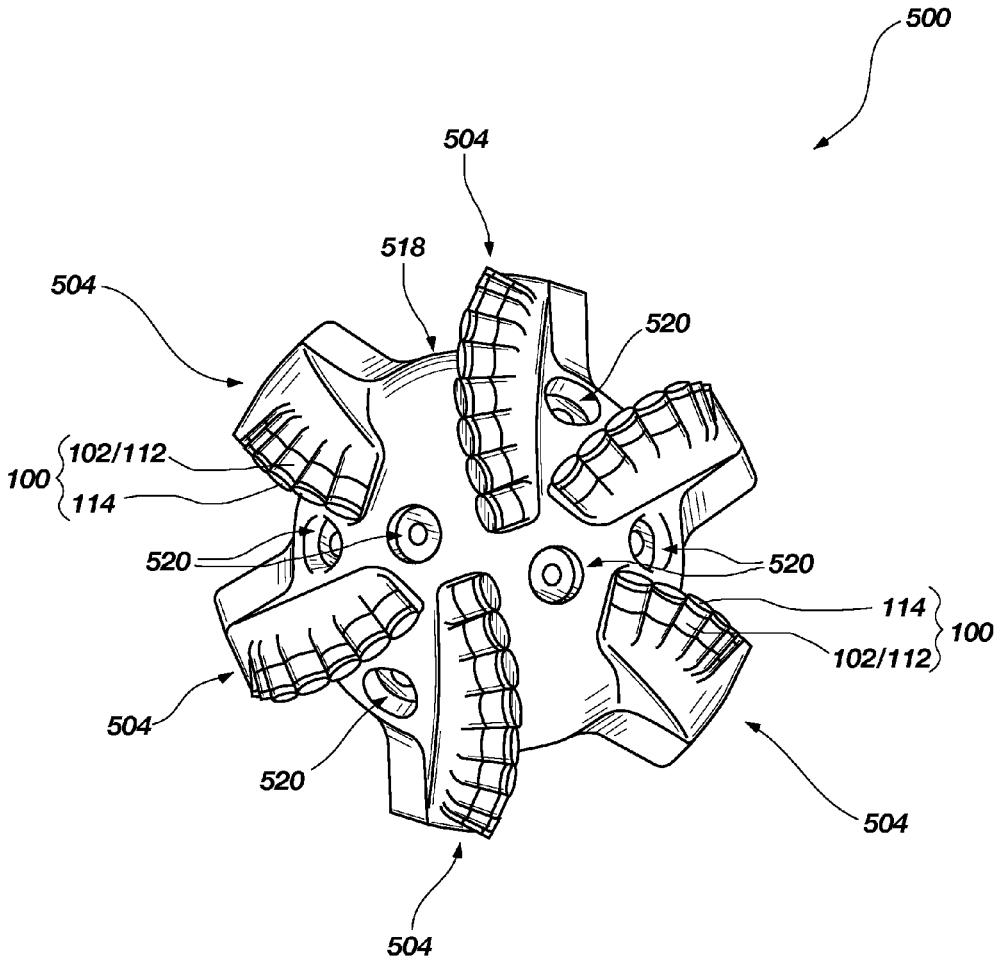
FIG. 5B is a top elevation view of the in-process rotary drill bit assembly shown in FIG. 5A.

FIG. 5A is an isometric view and FIG. 5B is a top elevation view of an embodiment of an in-process rotary drill bit assembly 500. The assembly 500 includes at least one superabrasive compact configured according to any of the previously described superabrasive compact embodiments. The rotary drill bit 500 comprises a bit body 502 that includes radially and longitudinally extending blades 504 with leading faces 506, and a threaded pin connection 508 for connecting the bit body 502 to a drilling string. The bit body 502 defines a leading end structure for drilling into a subterranean formation by rotation about a longitudinal axis 510 and application of weight-on-bit. Referring to FIG. 5B, one or more superabrasive compacts may be configured according to any of the previously described superabrasive compact embodiments and disposed within a corresponding recess 512 (FIG. 5C) formed in the bit body 502. For example, the recesses 512 may be blind holes, pockets, or another suitable receptacle formed in the bit body 502. In the illustrated embodiment, each of a plurality of the superabrasive compacts 100 is disposed within a corresponding one of the recesses 512 of the blades 504. However, in other embodiments, another superabrasive compact disclosed herein may be provided. In addition, if desired, in some embodiments, a number of the superabrasive compacts may be conventional in construction. Also, circumferentially adjacent blades 504 define so-called junk slots 518 therebetween, as known in the art. Additionally, the rotary drill bit 500 may include a plurality of nozzle cavities 520 for communicating drilling fluid from the interior of the rotary drill bit 500 to the PDCs 512.

Figure 5C:
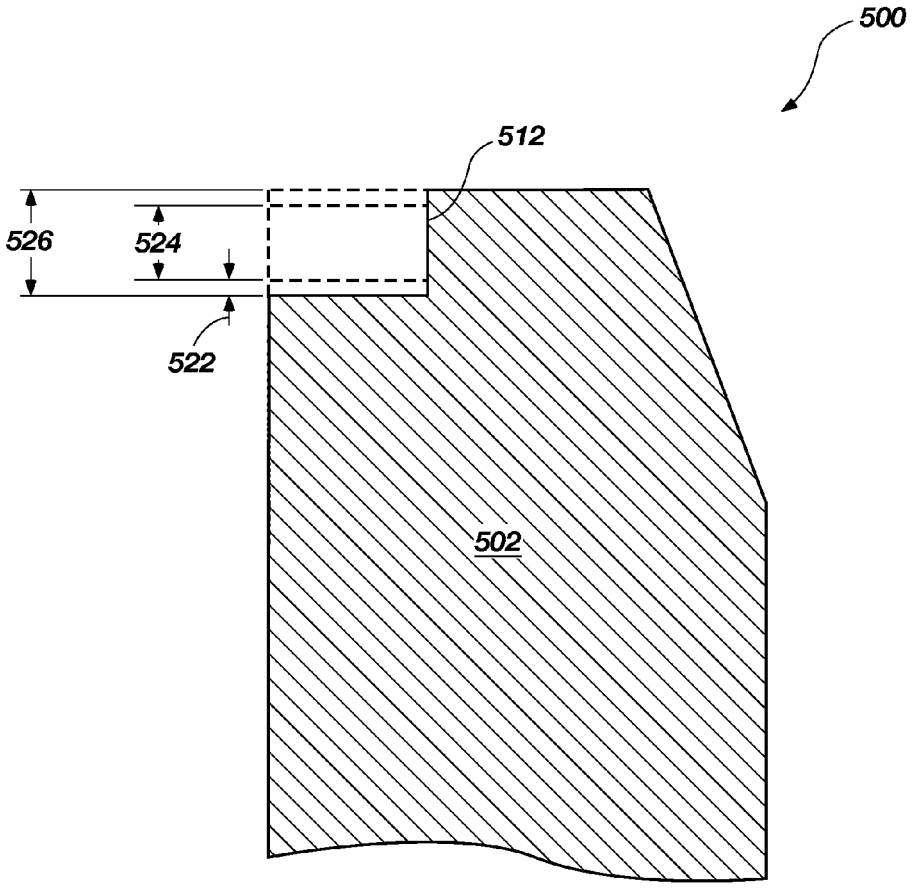
FIG. 5C is a partial cross-sectional view of the bit body shown in FIG. 5A taken along line 5C-5C, with the superabrasive compact removed.

FIG. 5C is a partial cross-sectional view of the bit body 502 shown in FIG. 5A taken along line 5C-5C, with the superabrasive compact 100 removed to illustrate a braze offset 522 between the substrate 102 of the superabrasive compact 100 and the interior of the recess 512. The braze offset 522 is defined between an outer diameter 524 of the substrate 102 of the superabrasive compact 100 and an inner diameter 526 of the recess 512. For example, the outer diameter 524 and the inner diameter 526 may each be substantially conventionally sized and the braze offset 522 may be greater than or equal to the thickness T2 (see FIG. 1B) of the side braze portion 112. As shown in the partial cross-sectional view of FIG. 5D, prior to brazing, the thickness T2 of the side braze portion 112 is chosen to be less than that of the braze offset 526.

Figure 5D:
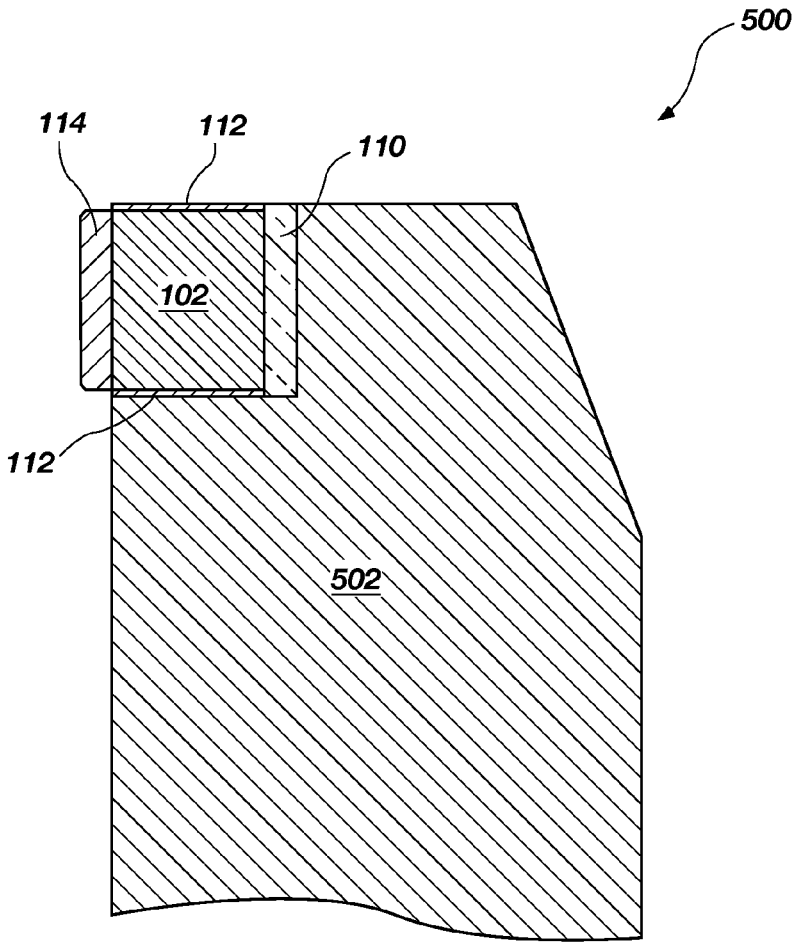
FIG. 5D is a partial cross-sectional view of the bit body shown in FIG. 5A taken along line 5C-5C, with the superabrasive compact shown in FIGS. 1A-1C positioned in a recess prior to being brazed to the bit body.

The in-process rotary drill bit assembly 500 shown in FIG. 5D may be fabricated by positioning the superabrasive compact 100 in a corresponding one of the recesses 512 followed by subjecting the in-process rotary drill bit assembly 500 to a suitable braze temperature cycle that melts and causes the braze alloy to reflow so that so that a strong metallurgical bond is formed between the substrate 102 and the bit body 502 upon cooling. For example, the braze temperature cycle may be performed by heating the in-process rotary drill bit assembly in a furnace, with a handheld brazing torch, or another suitable heating method. The brazing temperature depends, at least in part, on the liquidus temperature of the braze alloy. For example, typically, the brazing temperature may be about 600° C. to 1050° C., such as about 600° C. to about 750° C.

If the superabrasive compact 300 shown in FIG. 3 is used, the braze offset may be the tolerance stack-up between the substrate 102 and the inner diameter 526 of the recess 512 and the substrate 102 may be conventionally sized. During brazing the braze alloy melts and may flow into the braze offset.

FIGS. 5A and 5B merely depict one embodiment of a rotary drill bit that employs at least one cutting element that comprises a superabrasive compact fabricated and structured in accordance with the disclosed embodiments, without limitation. The in-process rotary drill bit assembly 500 is used to represent any number of earth-boring tools or drilling tools, including, for example, core bits, roller-cone bits, fixed-cutter bits, eccentric bits, bicenter bits, reamers, reamer wings, or any other downhole tool including PDCs, without limitation.

The superabrasive compacts disclosed herein may also be utilized in applications other than cutting technology. For example, the disclosed superabrasive compact embodiments may be used in wire dies, bearings, artificial joints, inserts, cutting elements, and heat sinks Thus, any of the superabrasive compacts disclosed herein may be employed in an article of manufacture including at least one superabrasive element or compact.

Thus, the embodiments of superabrasive compacts disclosed herein may be used in any apparatus or structure in which at least one conventional PDC is typically used. In one embodiment, a rotor and a stator, assembled to form a thrust-bearing apparatus, may each include one or more superabrasive compacts configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of superabrasive compacts disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. An in-process rotary drill bit assembly, comprising:

a bit body constructed from a unitary structure and configured to engage a subterranean formation, the bit body including a plurality of recesses formed therein, each of the plurality of recesses including a back surface and a side surface; and a plurality of superabrasive cutting elements, each of the superabrasive cutting elements positioned in a corresponding one of the plurality of recesses, one or more of the superabrasive cutting elements including:

a superabrasive table including a plurality of bonded superabrasive grains;

a substrate including an interfacial surface bonded to the superabrasive table, a base surface, and at least one side surface extending between the base surface and the interfacial surface, the at least one side surface of the substrate spaced from the side surface of the recess of the bit body by a braze offset; and at least one braze layer bonded to essentially all of the base surface prior to brazing the one or more of the superabrasive cutting elements to the bit body, the at least one side surface of the one or more superabrasive cutting elements being substantially free of the at least one braze layer, the at least one braze layer directly contacting the back surface of the corresponding one of the plurality of recesses and flowing into the braze offset during brazing.

2. The in-process rotary drill bit assembly of claim 1 wherein the at least one braze layer includes a foil that is bonded to only the base surface of the substrate.

3. The in-process rotary drill bit assembly of claim 1 wherein the at least one braze layer is welded to the substrate.

4. The in-process rotary drill bit assembly of claim 1, further comprising a wetting layer disposed on only the at least one braze layer.

5. The in-process rotary drill bit assembly of claim 4 wherein the wetting layer includes a flux.

6. The in-process rotary drill bit assembly of claim 1 wherein the at least one braze layer includes at least one braze alloy selected from the group consisting of a gold alloy, a silver alloy, and an iron-nickel alloy.

7. The in-process rotary drill bit assembly of claim 1 wherein the superabrasive table includes a leached region from which a metallic infiltrant has been at least partially removed.

8. The in-process rotary drill bit assembly of claim 1 wherein the superabrasive table includes a polycrystalline diamond table that is integrally formed with the substrate.

9. The in-process rotary drill bit assembly of claim 1 wherein the superabrasive table is a pre-formed polycrystalline diamond table.

10. The in-process rotary drill bit assembly of claim 1 wherein the substrate includes a cemented carbide material.

11. An in-process rotary drill bit assembly, comprising:

a bit body constructed from a unitary structure and configured to engage a subterranean formation, the bit body including a plurality of recesses formed therein, each of the plurality of recesses including a back surface and a side surface; and a plurality of superabrasive cutting elements, each of the superabrasive cutting elements positioned in a corresponding one of the plurality of recesses, one or more of the superabrasive cutting elements including:

a polycrystalline diamond table including a plurality of bonded diamond grains;

a substrate including an interfacial surface bonded to the polycrystalline diamond table, a base surface, and a generally cylindrical side surface extending between the base surface and the interfacial surface, the generally cylindrical side surface of the substrate spaced from the side surface of the recess by a braze offset; and at least one braze layer solely bonded to essentially all of the base surface, the at least one braze layer directly contacting the back surface of the corresponding one of the plurality of recesses and flowing into the braze offset during brazing.

12. The in-process rotary drill bit assembly of claim 11 wherein the polycrystalline diamond table is integrally formed with the substrate.

13. The in-process rotary drill bit assembly of claim 11 wherein the polycrystalline diamond table is a pre-formed polycrystalline diamond table.

14. The in-process rotary drill bit assembly of claim 11 wherein the at least one braze layer includes a foil that is bonded to only the base surface of the substrate.

15. The in-process rotary drill bit assembly of claim 11 wherein the at least one braze layer is tack welded to the substrate.

16. The in-process rotary drill bit assembly of claim 11, further comprising a wetting layer disposed on only the base braze portion.

17. An in-process rotary drill bit assembly, comprising:

a bit body constructed from a unitary structure and configured to engage a subterranean formation, the bit body including a plurality of recesses formed therein, each of the plurality of recesses including a back surface and a side surface; and a plurality of superabrasive cutting elements, each of the superabrasive cutting elements positioned in a corresponding one of the plurality of recesses, one or more of the superabrasive cutting elements including:

a cemented carbide substrate including an interfacial surface, a base surface, and at least one side surface extending between substantially perpendicularly to the base surface and the interfacial surface, wherein the bit body is constructed of a single material;

at least one braze foil that is bonded only to essentially all of the base surface of the cemented carbide substrate prior to brazing superabrasive cutting elements to the bit body, the at least one braze foil including at least one braze alloy selected from the group consisting of a gold alloy, a silver alloy, and an iron-nickel alloy, the at least one braze foil directly contacting the back surface of the corresponding one of the plurality of recesses and flowing into the braze offset during brazing;

a wetting layer disposed on only the at least one braze foil; and a polycrystalline diamond table integrally formed with the cemented carbide substrate and bonded to the interfacial surface of the cemented carbide substrate, the polycrystalline diamond table including a plurality of bonded diamond grains.

18. The in-process rotary drill bit assembly of claim 17 wherein the polycrystalline diamond table includes a leached region from which a metallic catalyst has been at least partially removed.

19. The in-process rotary drill bit assembly of claim 17 wherein the at least one braze foil is welded to the cemented carbide substrate.

20. The in-process rotary drill bit assembly of claim 17 wherein the cemented carbide substrate includes a cobalt-cemented tungsten carbide substrate.

* * * * *

UNITED STATES PATENT AND TRADEMARK OFFICE

CERTIFICATE OF CORRECTION

PATENT NO. : 8,960,338 B1
APPLICATION NO. : 13/864971
DATED : February 24, 2015
INVENTOR(S) : Galloway et al.

It is certified that error appears in the above-identified patent and that said Letters Patent is hereby corrected as shown below:

In the Claims

In Column 11, Lines 19-20, Claim 16, delete "only the base braze portion." and insert -- only the at least one braze layer. --, therefor.

Signed and Sealed this
Thirtieth Day of June, 2015

Michelle K. Lee

Michelle K. Lee
*Director of the United States Patent and Trademark Office*